US010679469B2

(12) United States Patent
Salmen et al.

(10) Patent No.: US 10,679,469 B2
(45) Date of Patent: Jun. 9, 2020

(54) SYSTEM AND METHOD OF MANAGING UNAVAILABLE ITEMS IN SHARED SCREEN DATA

(75) Inventors: Larry James Salmen, Fort Collins, CO (US); Steve Ulrich, Fort Collins, CO (US); Paul Ford Knight, Loveland, CO (US); Andrew John Fisher, Peterborough (GB)

(73) Assignee: NCR Corporation, Atlanta, GA (US)

( * ) Notice: Subject to any disclaimer, the term of this patent is extended or adjusted under 35 U.S.C. 154(b) by 248 days.

(21) Appl. No.: 12/900,598

(22) Filed: Oct. 8, 2010

(65) Prior Publication Data

US 2012/0089927 A1 Apr. 12, 2012

(51) Int. Cl.
*G07G 1/00* (2006.01)

(52) U.S. Cl.
CPC ..... *G07G 1/0009* (2013.01)

(58) Field of Classification Search
CPC ..... G06Q 20/20; G06Q 30/0259; G06Q 30/0639; G06Q 10/087
USPC ..... 715/753
See application file for complete search history.

(56) References Cited

U.S. PATENT DOCUMENTS 4,530,067 A * 7/1985 Dorr ..... G06Q 50/12 705/15
4,569,421 A * 2/1986 Sandstedt ..... G06F 13/24 186/39
5,003,472 A * 3/1991 Perrill ..... G06Q 10/087 235/375
5,800,264 A * 9/1998 Pascal et al. ..... 463/16
5,806,071 A * 9/1998 Balderrama ..... G06F 17/21
5,878,401 A * 3/1999 Joseph ..... 705/22
6,087,927 A * 7/2000 Battistini et al. ..... 340/286.09
6,829,583 B1 * 12/2004 Knapp et al. ..... 705/15
7,209,891 B1 * 4/2007 Addy et al. ..... 705/21
7,233,914 B1 * 6/2007 Wijaya et al. ..... 705/26.1
7,257,547 B1 * 8/2007 Terase ..... 705/15
7,328,171 B2 * 2/2008 Helot et al. ..... 705/27.2
2002/0007321 A1 * 1/2002 Burton ..... G06Q 10/087 705/51

(Continued)

FOREIGN PATENT DOCUMENTS

JP 2000-105786 A * 4/2000 ..... G06F 17/60

OTHER PUBLICATIONS

English machine translation of JP-2000-105768-A, "Information Management System in Restaurant", Apr. 11, 2000.*

*Primary Examiner* — Jennifer N To
*Assistant Examiner* — Joseph R. Burwell
(74) *Attorney, Agent, or Firm* — Schwegman, Lundberg & Woessner

(57) ABSTRACT

A system and method of managing unavailable items in shared screen data which provides access to modified screen data substantially simultaneously. The system includes a first computer including a display for displaying a screen containing items from screen data including modified screen data during a transaction. The modified screen data reflects that at least one of the items is unavailable. The first computer shares the screen data with a second computer. The first computer is also for displaying an indication that the at least one item is unavailable substantially simultaneously following modification of the screen data and upon selection of the at least one item at one of the first and second computers.

15 Claims, 11 Drawing Sheets

(56) References Cited

U.S. PATENT DOCUMENTS

| | | | | |
|---|---|---|---|---|
| 2003/0139937 | A1* | 7/2003 | Lee | G06Q 30/06 705/15 |
| 2004/0056761 | A1* | 3/2004 | Vaseloff et al. | 340/309.16 |
| 2004/0186783 | A1* | 9/2004 | Knight et al. | 705/16 |
| 2005/0004843 | A1* | 1/2005 | Heflin | 705/15 |
| 2005/0075934 | A1* | 4/2005 | Knight et al. | 705/15 |
| 2005/0200455 | A1* | 9/2005 | Veni et al. | 705/15 |
| 2005/0216349 | A1* | 9/2005 | Vaseloff et al. | 705/15 |
| 2006/0004675 | A1* | 1/2006 | Bennett et al. | 705/402 |
| 2007/0077883 | A1* | 4/2007 | Childers et al. | 455/3.05 |
| 2007/0168205 | A1* | 7/2007 | Carlson | G06Q 10/02 705/15 |
| 2007/0265935 | A1* | 11/2007 | Woycik et al. | 705/26 |
| 2008/0140460 | A1* | 6/2008 | Smith et al. | 705/5 |
| 2008/0162290 | A1* | 7/2008 | Leifer | 705/15 |
| 2008/0222004 | A1* | 9/2008 | Pollock et al. | 705/26 |
| 2009/0125682 | A1* | 5/2009 | Schroeder et al. | 711/115 |
| 2009/0252318 | A1* | 10/2009 | Smith et al. | 379/265.1 |
| 2009/0265247 | A1* | 10/2009 | Carroll et al. | 705/15 |
| 2009/0281817 | A1* | 11/2009 | Ferrara et al. | 705/1 |
| 2010/0201779 | A1* | 8/2010 | Inderrieden et al. | 348/14.01 |
| 2011/0078637 | A1* | 3/2011 | Inderrieden et al. | 715/866 |
| 2011/0153467 | A1* | 6/2011 | Salmen et al. | 705/28 |
| 2011/0307387 | A1* | 12/2011 | Francia | 705/65 |
| 2011/0307547 | A1* | 12/2011 | Backer et al. | 709/203 |

* cited by examiner

SYSTEM AND METHOD OF MANAGING UNAVAILABLE ITEMS IN SHARED SCREEN DATA

BACKGROUND

Self-service computer systems have replaced assisted-service computer systems in many business environments today. For example, self-service computer systems may be found in banking, retail, hospitality, travel, entertainment, medical, and other environments.

Self-service computer systems allow customers to complete transactions without assistance; however, there are instances where customers require some level of assistance, such as in quick service or pre-order pre-pay venues.

In quick service restaurants, it is often difficult to predict demand for various menu items. As a result, certain items can be unavailable.

A good example would be French fries where the cook is attempting to balance having just enough fries on hand to meet demand, but not too much that a portion of a batch would spoil and have to be wasted. Managing exactly what to prepare, how much and when to prepare it is a complex business problem for a quick service restaurant to manage.

Occasional food delays or out-of-stock items are not uncommon at quick service restaurants. There are typically two cases of delays: delays for pre-prepared items and delays for made-to-order items. Pre-prepared items are items that should always be prepared for immediate consumption. Made-to-order items are made after an order is placed.

In a store that does not have self service, both types of delay are easily handled by the clerk, who tells a customer an ordered item is either out of stock or will take a few extra minutes to prepare and asks if they want to wait. In contrast, in a restaurant where customers are ordering from a self-service kiosk, there is no current method to alert the kiosk customer of these two types of delays. As such, customers who order items on the kiosk that are currently unavailable but are available for purchase become frustrated because their food may not be delivered for up to fifteen minutes after the order was placed.

A good example is a chicken restaurant where the cook times are relatively long such that any out of stock situation could result in up to a fifteen minute wait for customers ordering such out of stock items. This length of wait would be unacceptable to customers and negate the benefit from self-service kiosk ordering.

Therefore, it would be desirable to provide a system and method of managing unavailable items in a self-service environment.

SUMMARY

A system and method of managing unavailable items in shared screen data is provided.

In an example embodiment, the system includes a first computer including a display for displaying a screen containing items from screen data including modified screen data during a transaction. The modified screen data reflects that at least one of the items is unavailable. The first computer shares the screen data with a second computer. The first computer is also for displaying an indication that the at least one item is unavailable substantially simultaneously following modification of the screen data and upon selection of the at least one item at one of the first and second computers.

In an example embodiment, the method includes determining a screen containing items from screen data including modified screen data reflecting that at least one of the items is unavailable, sharing the screen data with a second computer by a first computer, recording a selection of the at least one item at one of the first and second computers, and displaying an indication that the at least one item is unavailable by the first computer.

DETAILED DESCRIPTION

Figure 1:
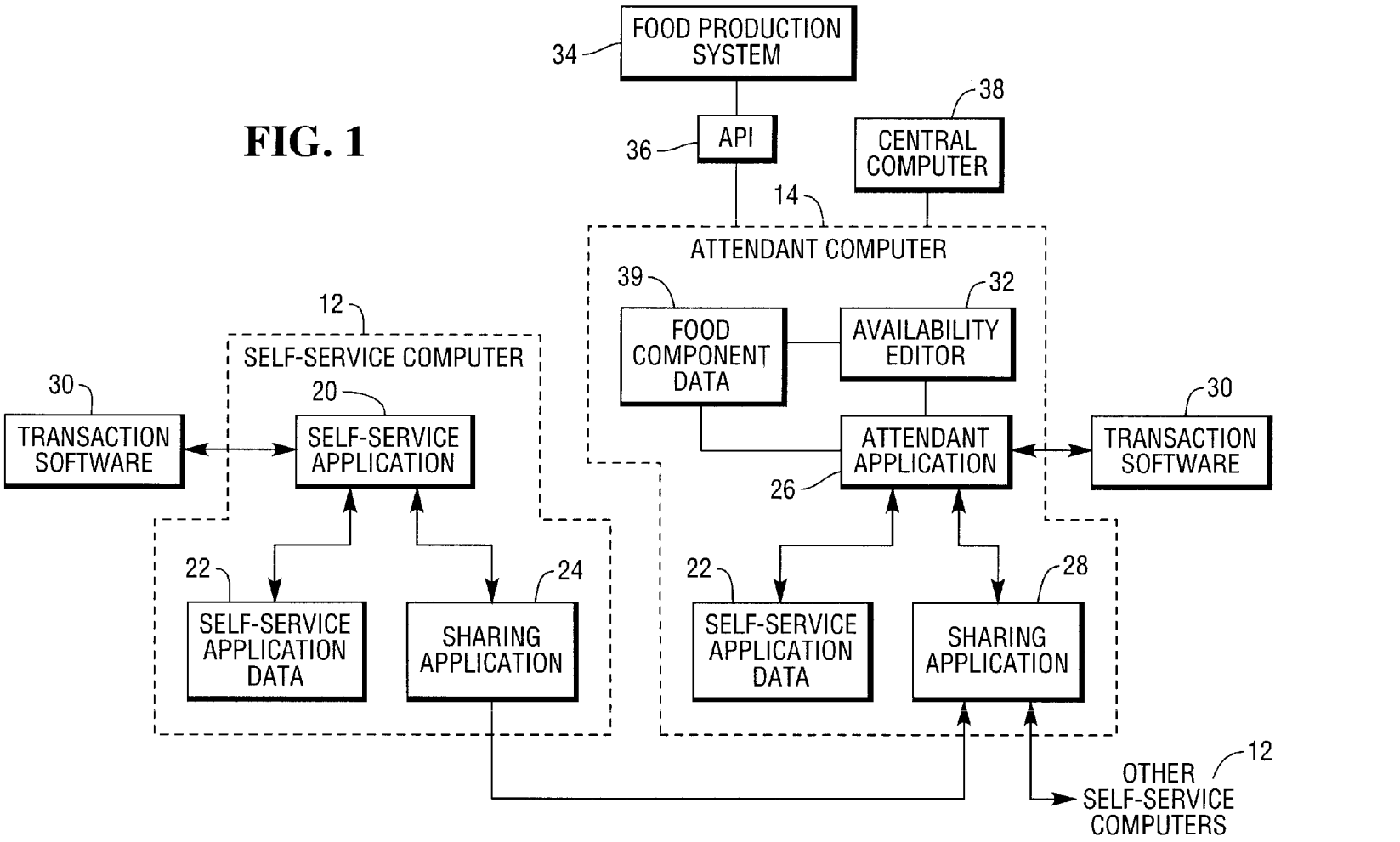
FIG. 1 illustrates a block diagram of an example embodiment of a transaction system.

Referring now to FIG. 1, an example embodiment of system 10 includes one or more self-service computers 12 and attendant computer 14 in a quick service or pre-order pre-pay kiosk in a fast food restaurant environment.

Self-service computer 12 and attendant computer 14 may be coupled together by a network. The network may be a proprietary network or a global communication network, such as the Internet.

Self-service computer 12 and attendant computer 14 may be located in close proximity to another so that an attendant may see and verbally interact with a customer.

Alternatively, self-service computer 12 and attendant computer 14 may be located separately from each other. For example, self-service computer 12 may include a quick service kiosk in a drive-through lane or a quick service kiosk in a play area.

Self-service computer 12 includes a processor, memory, program and data storage, a display, and one or more user input devices. The display and user input device may be combined as a touch screen. Self-service computer 12 additionally includes components and peripherals necessary to accomplish its purpose for the environment it is in. For example, self-service computer 12 may additionally include, but not be limited to, one or more payment peripherals and a printer.

For example, the display may display a graphic user interface and software for completing a transaction. The input device or touch screen may capture self-service user selections. The payment peripherals may include a card reader for reading credit, debit, and/or loyalty cards. The printer may print a receipt, coupons, and other promotions.

Self-service computer 12 may execute an operating system such as a Microsoft operating system, which can display screen information within one or more windows.

Self-service computer 12 allows a self-service customer to perform a transaction with or without assistance from an attendant at attendant computer 14. Self-service computer 12 executes self-service application 20 for this purpose. Self-service application 20 displays screens from self-service application data 22. The screens including currently displayed image data and selections available to a customer. Self-service application data 22 may be stored locally or remotely on a server.

Self-service application 20 may include screens and other display data and user input data. For example, display data may include data defining a currently displayed screen, including selections available to a customer, and selections recorded by the customer.

Self-service computer 12 additionally executes sharing application 24, which sends information to attendant computer 14, including the identity of a currently displayed screen and any selections made by a customer on that screen. Sharing application 24 further receives selections made by an attendant at attendant computer 14.

Self-service application 20 stores the selections as updates to self-service application data 22. Thus, sharing application 24 ensures that locally stored self-service application data 22 on self-service computer 12 is synchronized with self-service application data 22 stored by attendant computer 14. A customer at self-service computer 12 sees the same display information that is displayed by attendant computer 14. The customer can make selections and the attendant can watch the customer selections in real time as they are performed at attendant computer 14.

Self-service application 20 may optionally couple to other transaction software 30, either resident on self-service computer 12 or on one or more other computers connected to self-service computer 12 via a network. For example, transaction software 30 may be software provided by one vendor and self-service application 20 may be software provided by another vendor. For example, transaction software 30 may provide payment processing functions and self-service application 20 and attendant application 26 may hand-off payment processing to transaction software 30

Self-service computer 12 may include an interface software layer between self-service application 20 and transaction software 30. For example, self-service computer 12 may send order information through the software layer to transaction software 30.

In other environments, such as single vendor environments, the functions of transaction software 30 may be fully included within self-service application 20 and attendant application 26.

In yet other environments, self-service computer 12 and attendant computer 14 may operate as a stand-alone system, independent of any existing point of sale system.

Attendant computer 14 includes a processor, memory, program and data storage, a display, and one or more user input devices. The display and user input device may be combined as a touch screen. Attendant computer 14 may additionally include components and peripherals necessary to accomplish its purpose for the environment it is in. For example, attendant computer 14 may include a receipt printer, payment peripherals, and alert peripherals.

Attendant computer 14 is coupled to one or an unlimited number of self-service computers 12. Attendant computer 14 allows an attendant to interact with a customer at any of self-service computers 12 during a transaction. Attendant computer 14 executes attendant application 26, which access local or remote copies of self-service application data 22 associated with each of the self-service computers 12 to obtain data defining a screen currently displayed by one or more self-service computers 12, including selections available to a customer, and selections already recorded by the customer.

Attendant computer 14 further executes sharing application 28, which receives the identity of the screen currently displayed by self-service application 20, and any selections made by a customer on that screen. Attendant application 26 receives updated controls and corresponding screen position information whenever any of self-service computers 12 receive these updates. These updates may be in the form of common and customized dialogs and dialog position information.

Attendant application 26 stores the screen identity information and the selections in the locally stored copy of self-service application data 22. Thus, sharing application 28 ensures that locally stored self-service application data 22 on attendant station 14 is synchronized with self-service application data 22 stored on self-service computer 12. An attendant at attendant computer 14 sees the same display information that is displayed by self-service computer 12. The attendant can make selections on behalf of the customer and the customer can watch the attendant selections as they are performed at self-service computer 12.

Attendant computer 14 may have different access rights to information in self-service application data 22. Self-service computer 12 may have limited access rights to some information. For example, only attendant computer 14 may access information necessary for ordering staff meals, processing wastage, and for processing coupons or discounts.

Attendant computer 14 may present information from self-service application data 22 in the same way as self-service computer 12 or in a different way. For example, self-service computer 12 may present a rich content view with audio, animations, variable screen transitions, and other modern graphic user interface features to enhance customer experience. On the other hand, attendant computer 14 may present a more simple view of the screen information displayed on self-service computer 12, without the multimedia and graphic user interface enhancements, particularly if computer processor or graphic engine speed and memory resources are limited on attendant computer 14.

In environments in which separate transaction software 30 exists, attendant computer 14 may include an interface software layer between attendant application 26 and transaction software 30.

Attendant computer 14 also executes availability editor 32, which allows a store manager to modify indications of availability for items. For example, availability editor 32 may record store manager selections for items which are currently unavailable for purchase and delivery during a current transaction. Such items may be unavailable for purchase and delivery for an indefinite period of time. When the items are available again, availability editor 32 records store manager selections for these items making them once again available.

As another example, availability editor 32 may record store manager selections for items which are currently available for purchase, but temporarily unavailable for delivery to customers during a current transaction. In practice, the store manager may mark such items as unavailable for the current day or until the items become available again following a delay period. Availability editor 32 may record store manager entry of a delay period until such items are available again and can be delivered to the customers. Otherwise, when the items are available again, availability editor 32 may record store manager selections for these items making them once again available.

Availability editor 32 may obtain a list of items that may be unavailable from central computer 38. Central computer 38 may be located at a corporate headquarters of the restaurant or a franchisor of the restaurant.

Alternatively, availability editor 32 may obtain a list of both available and unavailable items from a food component database 39 stored locally or at central computer 38.

Attendant application 26 modifies self-service application data 22 to reflect the changes made by availability editor 32 so that both self-service application 20 and attendant application 26 display indications of unavailability of items.

In an alternative embodiment, availability decisions may be made at a back of office food production system 34 operated by a food supplier to the restaurant. API 36 facilitates communication between food production system 34 and attendant application 26.

Attendant computer 14 may execute an operating system such as a Microsoft operating system, which can display screen information within one or more windows.

Self-service application 20 may initiate a request for help from an attendant. Attendant application 26 recognizes the request and activates an audible and/or visible alarm or message intended for the attendant. The attendant may provide any measure of help requested by the customer. One of the advantages of system 10 is providing customer training to help customers complete transactions with minimal assistance. However, in some circumstances, the attendant may offer to complete the remainder of a transaction on behalf of the customer. For example, the attendant may offer to complete the remainder of a transaction when there are long customer queues or when higher customer throughput is desirable.

If self-service computer 12 and attendant computer 14 are located in proximity with each other, the customer and attendant may communicate face-to-face. Otherwise, a customer may communicate with an attendant via other communication methods, such as live chat, instant messaging, verbal collaboration, network or close circuit or other type of audio and/or video feed, or over a telephone connection. Self-service application 20 and attendant application 26 may include capabilities to communicate using these methods.

For example, if self-service computer 12 is located at a drive-through lane, self-service computer 12 and attendant computer 14 may include a network or other type of audio feed. Screen area may additionally be allocated to displaying images of the customer and/or the attendant via a network or other type of video feed and cameras in self-service computer 12 and attendant computer 14.

Attendant computer 14 may be one of a plurality of attendant computers 14 which has responsibility for a number of self-service computers 12. Each attendant computer 14 may be configured to yield control to another attendant computer 14. Thus, the system configuration may be tailored to transaction volume. During high transaction volumes, each attendant station 14 may be manned. During low transaction volumes, fewer than all attendant stations 14 may be manned. If one of attendant computers 14 is not working properly, another attendant computer 14 may take control of self-service computers 12 managed by the non-functioning attendant computer 14.

Attendant computer 14 may actively monitor the health and status of self-service computer 12. Attendant computer 14 may display alerts to the attendant if error conditions occur at self-service computer 12. Attendant computer 14 may keep an error log.

Figure 2:
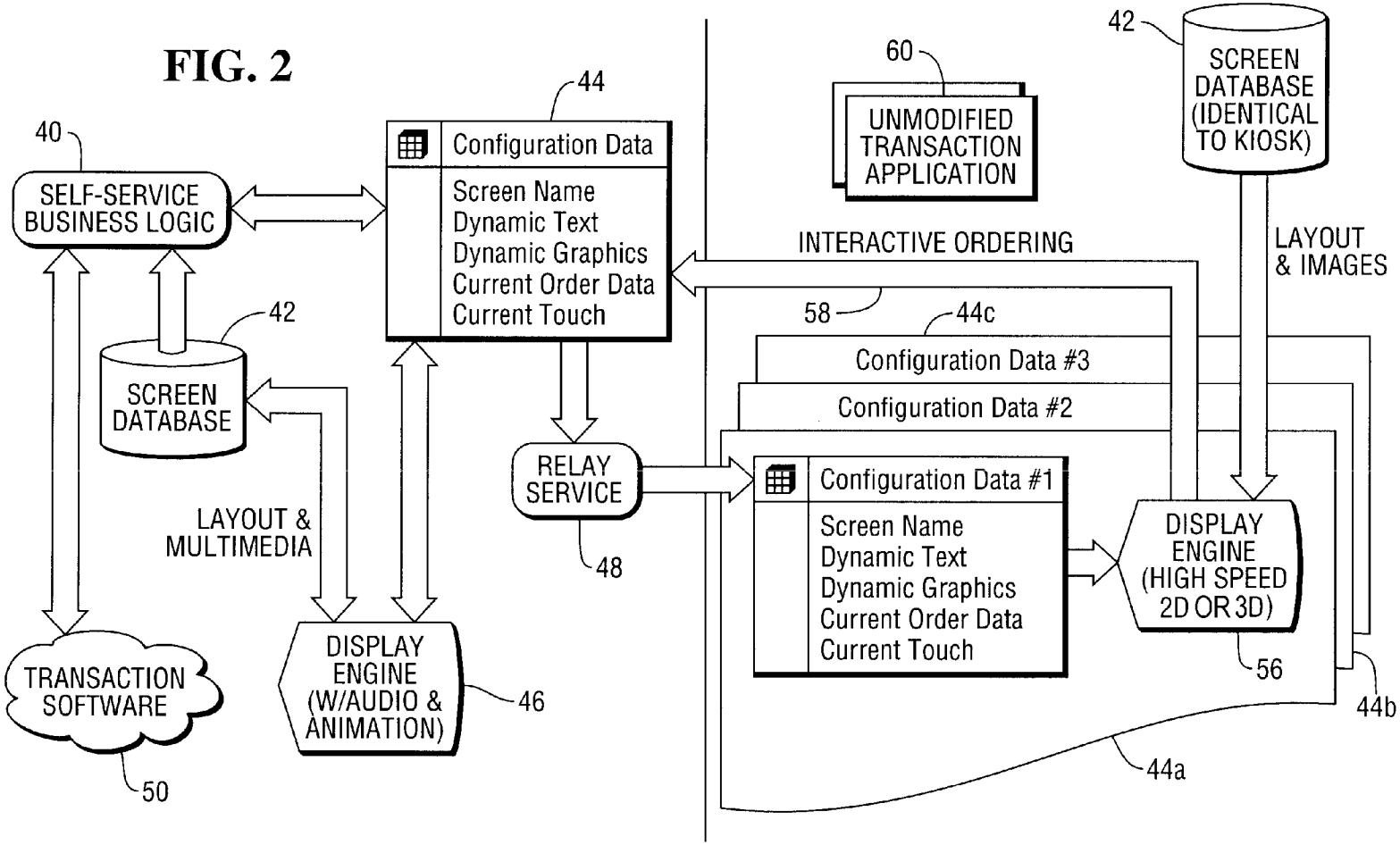
FIG. 2 illustrates an architectural diagram illustrating software components involved in establishing interaction between a self-service computer and an attendant computer.

Turning now to FIG. 2, an example embodiment of the architecture of system 10 is illustrated.

Self-service computer 12 includes self-service business logic 40, screen database 42, configuration data 44, display engine 46, and relay service 48.

Self-service business logic 40 controls transaction related functions of self-service computer 12, including control over which screens from screen database 42 are displayed. Self-service business logic 40 may rely on additional transaction software 50, either local or remote, to complete some transaction related functions related to the purpose of self-service computer 12, such as completing payment and maintaining loyalty information.

Self-service business logic 40 maintains a record of currently displayed screens by screen name or other identifier in configuration data 44. Configuration data 44 may include registry data in self-service computers 12 and attendant computers 14 configured with a Microsoft operating system.

Self-service business logic 40 maintains a record of other transaction related information in configuration data 44, such as current customer input data, current order data, and any dynamic graphics or text data that is used in displaying screens.

Display engine 46 obtains current screen information dictated by self-service business logic 40 from configuration data 44. Display engine 46 obtains screen data from screen database 42. Screen data may include screen objects, screen layout information, instructions for displaying screens, any graphics or multimedia files or links to graphics or multimedia files associated with the screens, and links to other data associated with the screens.

Display engine 46 obtains current input data from configuration data 44, including current selections made by either a customer or by an attendant. Display engine 46 dynamically generates displayed screens from both screen data and input data.

Relay service 48 monitors for and identifies changes in configuration data 44 and sends them over the network connection between self-service computer 12 and attendant computer 14.

Attendant computer 14 includes screen database 42, configuration data 44, display engine 56, and interactive ordering logic 58.

Screen database 42 contains substantially identical screen data as found in the screen database 42 of self-service computer 12. Both screen databases 42 may be synchronized or combined into a single screen database 42 shared by both self-service computer 12 and attendant computer 14. The single screen database 42 may be stored on a server.

Configuration data 44 includes substantially identical configuration data found in configuration data 44 of self-service computer 12. Both sets of configuration data 44 are synchronized by relay service 48. If there is more than one self-service computer 12, attendant computer 14 stores configuration data 44 for each self-service computer 12. In the illustrated example, attendant computer 14 stores three sets of configuration data 44*a-c* for three self-service computers 12; however, attendant computer 14 may connect with any number of self-service computers 12 and store associated configuration data 44.

As changes occur in configuration data 44 at self-service computer 12, relay service 48 updates corresponding configuration data 44 on attendant computer 14.

Changes in configuration data 44 at self-service computer 12 may include changes made at attendant computer 14 and transferred to self-service computer 12 by interactive ordering logic 58. Changes at attendant computer 14 may include attendant selections.

Interactive ordering logic 58 monitors for and identifies changes in configuration data 44 at attendant computer 14 and sends them over the network connection between self-service computer 12 and attendant computer 14 to be stored in configuration data 44 at self-service computer 12. Thus, selections made by an attendant are substantially immediately visible to a customer at self-service computer 12.

While the attendant is making selections, the customer can see the screen flow dialogue at self-service computer 12. Advantageously, the attendant can provide training and encourage customers to use self-service computer 12, resulting in an increase in utilization of self-service computer 12 and fewer customers walking away.

Attendant computer 14 may rely on additional transaction software 60, either local or remote, to complete some transaction related functions related to the purpose of self-service computer 12, such as completing payment. In example venues in which self-service computer 12 and attendant computer 14 are located in close proximity to one another, attendant computer 14 may take cash payment from customers. Thus, self-service computer 12 would not require expensive cash payment components, such as coin/bill acceptors/dispensers.

Figure 3:
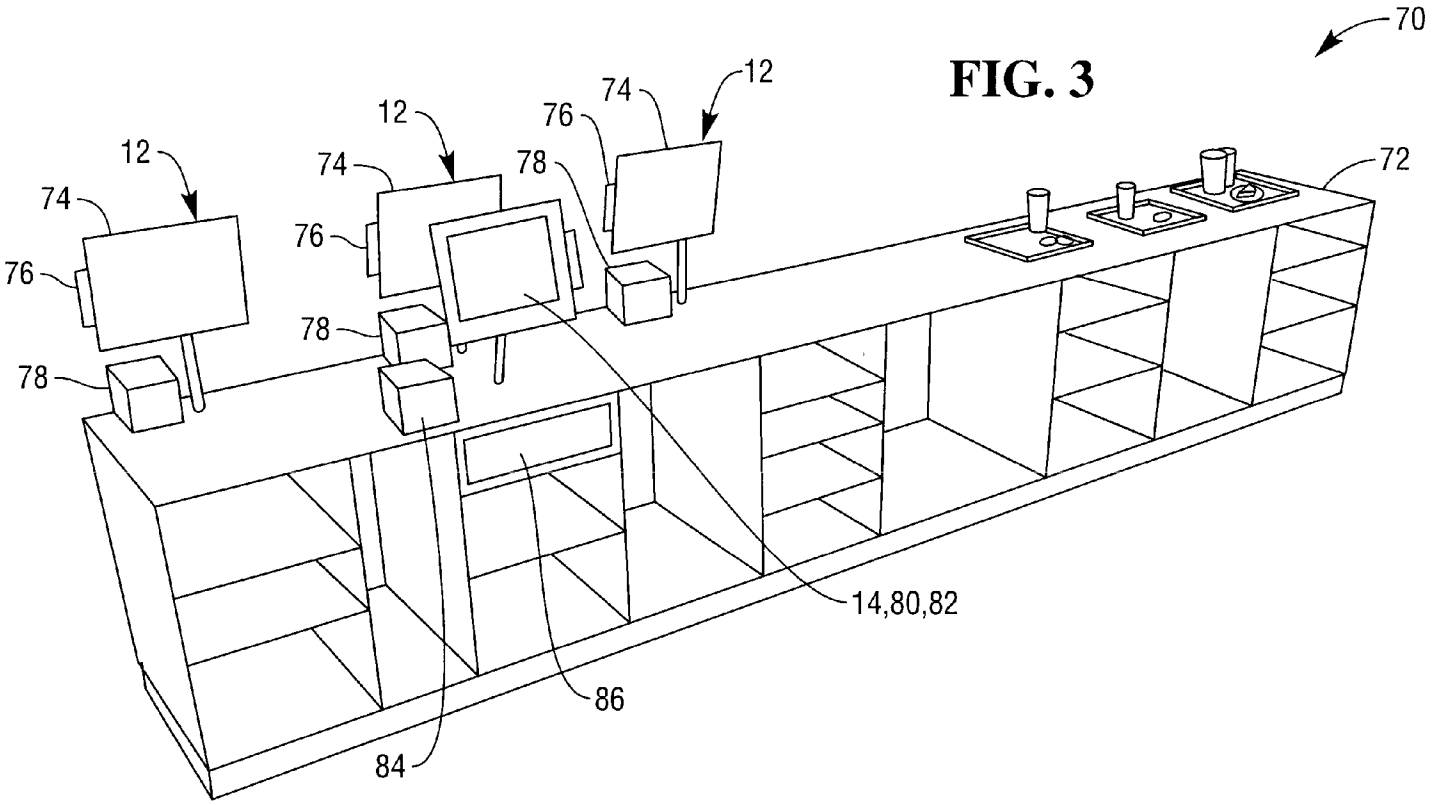
FIG. 3 illustrates an example self-service system.

Turning now to FIG. 3, an example self-service system 70 is illustrated.

Self-service system 70 includes service counter 72, one or more self-service computers 12, and one or more attendant computers 14. This illustration includes three self-service computers 12 facing a customer side of counter 72 and one attendant computer 14 in close proximity to the self-service computers 12 and facing an attendant side of counter 72. However, attendant computer 14 may manage additional self-service computers 12, including one or more self-service computers 12 in drive-through lanes. Attendant computer 14 may also be coupled to transaction software 30, including POS software, for handling some payment functions.

Example self-service computers 12 each include a computer 74, card reader 76, and printer 78. Computer 74 includes a touch screen. Computer 74 may be equipped with multimedia capability, including multimedia graphics display hardware and audio playing hardware. Card reader 76 facilitates payment by card. Printer 78 is a receipt printer.

Example self-service computers 12 may include additional peripherals. For example, self-service computers 12 may include barcode readers for reading barcodes on customer-provided coupons.

Example attendant computer 14 includes computer 80, card reader 82, printer 84, and cash drawer 86. Computer 80 includes a touch screen, but may include separate display and input devices, such as a keyboard. Card reader 82 facilitates assisted payment by card. Printer 84 is a receipt printer for assisted payment transactions. Cash drawer 86 stores cash for cash transactions and personal and traveler checks for check transactions. Since the attendant stands in close proximity to the customers, the attendant can process all cash transactions.

In this example, self-service computers 12 require no cash payment peripherals. However, self-service computers 12 in other environments, particularly environments in which self-service computers 12 are remotely located from attendant computer 14, self-service computers 12 may require cash payment peripherals including one or more of currency and coin dispensers and acceptors.

For example, a self-service computer 12 in a quick service drive-through, a quick service play place, a shopping mall food court, or other remote venue may require cash payment peripherals. Cash payment peripherals can also be used at the front counter to reduce the attendant's role and allow more flexibility in labor scheduling and redeployment.

Example attendant computer 14 may include additional peripherals. For example, attendant computer 14 may include a barcode reader for reading barcodes on customer-provided coupons.

The attendant can also perform many traditional food delivery and store operation functions while performing attendant functions. For example, in monitoring beverage orders at self-service checkout computers 12, the attendant can identify and provide the number of cups required by each transaction from a cup container behind counter 72. Advantageously, using the attendant in this way provides major savings in labor costs.

Attendant computer 14 may include audio and/or visual alerts to capture the attendant's attention. Attendant computer 14 may include alerting peripherals including an add-on light or combination of different lights, a beeper, a buzzer, or a messaging system to wirelessly contact an attendant beeper or cell phone.

Figure 4:
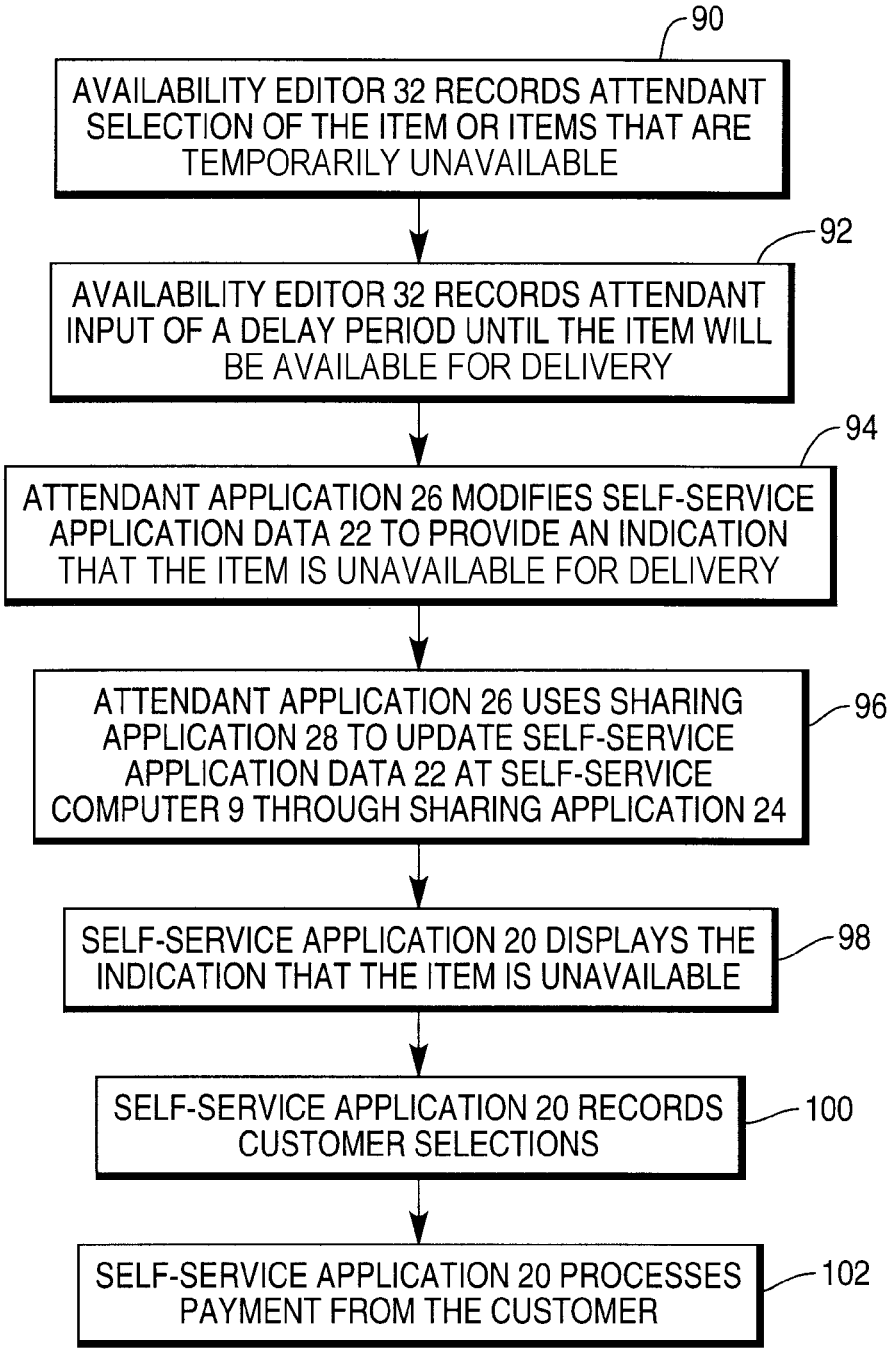
FIG. 4 illustrates an example method of managing unavailable items.
Figure 5:
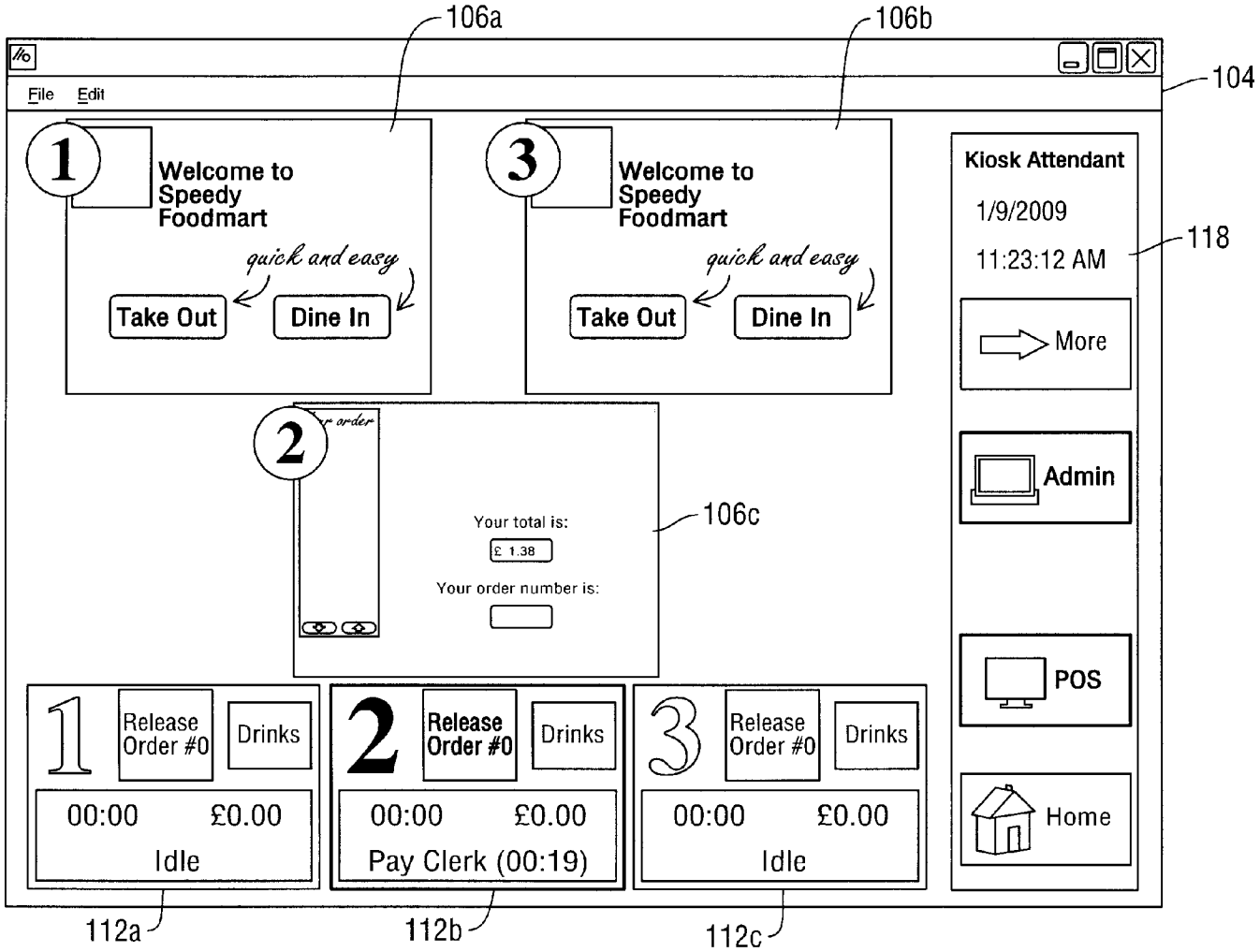
FIGS. 5-8 illustrate an example method of marking items as unavailable.

Turning now to FIG. 4, a first example method of managing unavailable items is illustrated.

In step 90, availability editor 32 at attendant station 14 or food production system 34 records attendant selection of the item or items that are temporarily unavailable for delivery during current transactions.

In step 92, availability editor 32 records attendant input of a delay period until the item will be available for delivery. If the delay period is unknown or too long compared to an average transaction time, then availability editor 32 may record a change in status of the item from available for purchase but temporarily unavailable for delivery to unavailable for purchase and delivery to prevent ordering of the item.

In step 94, attendant application 26 modifies self-service application data 22 to provide an indication that the item is unavailable for delivery.

In step 96, attendant application 26 uses sharing application 28 to update self-service application data 22 at self-service computer 12 through sharing application 24. When an item is marked as unavailable for delivery at attendant station 14, the unavailability is substantially immediately sent to self-service computer 12 via sharing application 24.

In step 98, self-service application 20 displays the indication that the item is unavailable for delivery.

If the item is available for purchase but temporarily unavailable for delivery, a delay period may be included. Self-service application 20 may additionally display the delay period until the item can be delivered, including a countdown timer. If multiple items are delayed at the same time, self-service application 20 may display the longest delay time of the items. If the item becomes available for delivery before the delay period expires, availability editor 32 may process a further change to remove the temporary unavailability indication.

In an alternative embodiment, a time period may be included, but may not count down. This alternative embodiment may be relevant to made-to-order item, as opposed to pre-prepared items where a count down may be desirable.

In step 100, self-service application 20 records customer selections.

If a desired item is only temporarily unavailable for delivery, a customer may see the indication and choose to either select a different item and not wait, or select the item and wait until it is available for delivery.

If a desired item is made-to-order, a customer may see the indication and choose to either select a different item and not wait, or select the item and wait until it is made and delivered following ordering.

The indication may be displayed only when a customer selects the item. For example, when a customer tries to select French fries, which are available for purchase but temporarily unavailable for delivery, self-service application 20 may display a message box containing the message, "We are now making fresh: Fries. Would you like to wait 3 minutes". The message box may include "yes" and "no" buttons, thereby allowing a customer to affirm or cancel the selection of French fries. (See FIG. 11)

As another example, when a customer tries to select a custom sandwich, self-service application 20 may display a message box containing the message, "This item is made-to-order and will take 5 minutes to prepare following completion of this order. Would you like to wait?". The message box may include "yes" and "no" buttons, thereby allowing a customer to affirm or cancel the selection of customer sandwich.

Alternatively, the modification may result in the message being displayed continuously, for example, on a screen containing the unavailable item.

If an item's status has been changed to unavailable for purchase and delivery, the indication may include graying out the item to prohibit its purchase and selection and/or displaying a message continuously, for example, on a screen containing the unavailable item.

In step 102, self-service application 20 processes payment from the customer. For example, self-service application 20 may process a customer credit card using a card reader coupled to self-service computer 12.

The customer proceeds to service counter 72 to take delivery of the food order. If the customer purchased a temporarily unavailable item, such as a made-to-order item, the customer waits for the item until it is available for delivery.

With reference to FIGS. 5-9, an example method of marking an item as unavailable item is illustrated starting with an attendant screen 104 of attendant application 26.

Example screen 104 includes three numbered display sections 106*a*, 106*b*, and 106*c* associated with information displayed by three self-service computers 12, and corresponding numbered control sections 112*a*, 112*b*, and 112*c*. Attendant application 26 is capable of displaying fewer or more display sections. Example screen further includes an administrative section 118 containing administrative choices available to an attendant.

Attendant application 26 may be configured to display Screen 104 as a window as illustrated or full screen.

An attendant may assist a customer with ordering items by selecting the numbered display of the customer's self-service computer 12. In response to a touch in any of display sections 106*a*, 106*b*, or 106*c* or in a corresponding control section 112*a*, 112*b*, or 112*c*, attendant application 26 causes a chosen display section to zoom to full screen view with full touch control, with the attendant able to make the same selections as the customer. Attendant application 26 rapidly displays any customer button touches and changes in displayed information from self-service application 20. Attendant computer 14 is capable of displaying all customer operation of self-service computer 14, including when a customer places an order for food items and when the order is complete and the customer chooses a payment method. Attendant application 26 receives updated controls and corresponding screen position information whenever any of self-service computers 12 receive these updates. These updates may be in the form of common and customized dialogs and dialog position information.

Administrative section 118 includes attendant control buttons. A "Home" button displays the multiple self-service computer screens.

A "POS" button displays a POS software screen for completing payment, for example, bringing it to the forefront or displaying it separately from attendant application 26.

An "Admin" button displays a screen indicating the status of each self-service computer 12 and allows the attendant to activate, deactivate or reboot the self-service computers 12.

A "More" button displays any additional screens following selection of the Home, Admin, and POS buttons.

In this example, unavailable items may be processed by selecting "Admin" in attendant screen 104.

Figure 6:
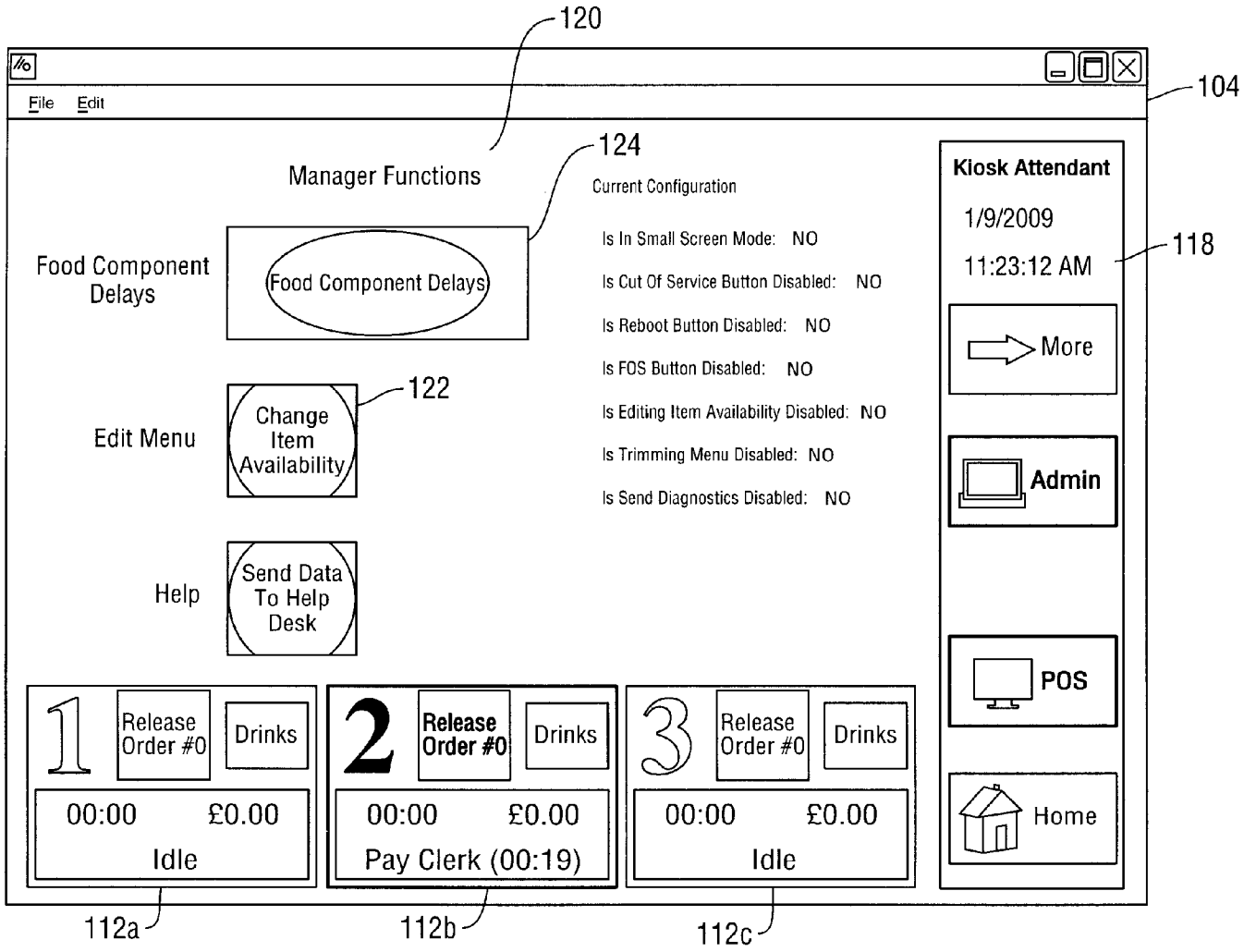

With reference to FIG. 6, selecting "Admin" causes attendant application 26 to display a Manager Functions screen 120, which appears in the forefront over example attendant screen 104. One example method of combining a screen with attendant screen 104 in a Microsoft Windows environment is to identify a rectangular region where the screen will reside, assign a certain color to the region, and designate the color as being a "transparency key". The Microsoft Windows API makes the pixels completely transparent, allowing the screen to appear.

Manager Functions screen 120 includes a Change Item Availability button 122 for editing menus of items. Selection of the Change Item Availability button 122 allows an attendant to make items in food menus available for purchase and delivery, available for purchase but not currently available for delivery, or unavailable for purchase and delivery. Temporarily unavailable items are items which are available for purchase but not available for delivery. Selecting Change Item Availability button 122 causes attendant application 26 to execute availability editor 32. Availability editor 32 displays screens which appears in the forefront over example attendant screen 104.

Manager Function screen 120 further includes a Food Component Delays button 124 for setting food component delays for items which are available for purchase, but not available for delivery. Selection of the Food Component Delays button 124 allows an attendant to set delay periods or estimated times of arrival (ETAs) of food items.

Figure 7:
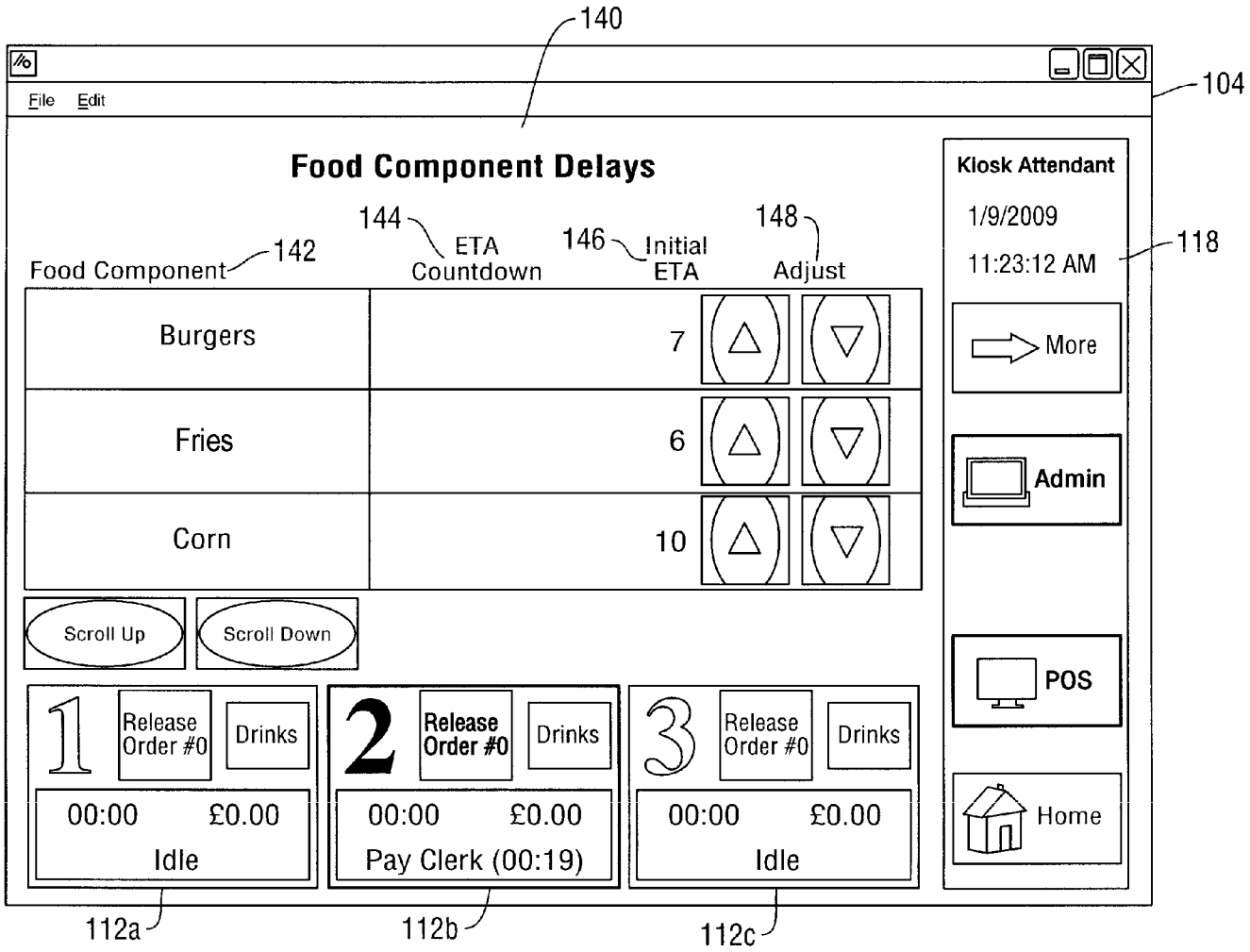

With reference to FIG. 7, selecting Food Component Delay button 124 causes attendant application 26 to display Food Component Delays screen 140, which appears in the forefront over example attendant screen 104.

Food Component Delays screen 140 includes rows of food components identified in food component database 39. Food Component Delays screen 140 further includes columns, including Food Component column 142, ETA Countdown column 144, Initial ETA column 146, and adjust column 148.

Food Component column 142 includes names of food components. ETA Countdown column 144 includes a countdown time for items marked as temporarily unavailable. Initial ETA column 146 includes a delay period to countdown for items marked as available for purchase but temporarily unavailable for delivery. Adjust column 148 includes up and down arrow buttons for adjusting the delay period to countdown.

Figure 8:
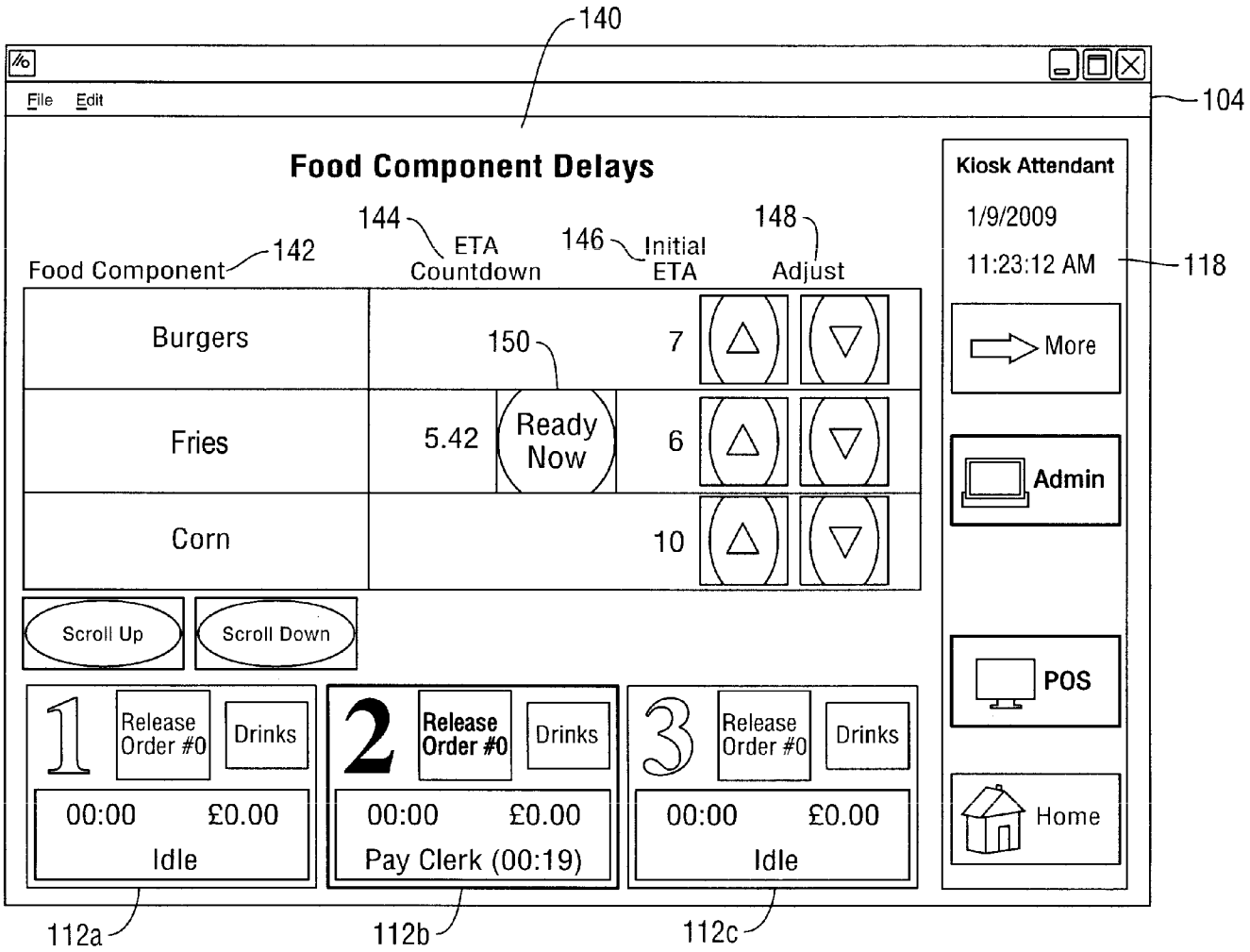

With reference to FIG. 8, Food Component Delays screen 140 displays an attendant selection of "Fries" under the Food Component column 142 for delay. The attendant has used up and down arrow buttons in Adjust column 148 to select a delay period under Initial ETA column 146 of six minutes. ETA Countdown column 144 shows a countdown time of 5:42 minutes, 18 seconds having elapsed since selection of the delay period. A Ready Now button 150 appears following selection of the delay period and allows the attendant to change the availability of Fries before expiration of the delay period from unavailable to available. Otherwise, the Fries become automatically available following expiration of the delay period.

Enhancements to the Component Delays screen 140 may include using different colors to distinguish available items from unavailable items. For example, rows corresponding to available items may be displayed in green, while rows corresponding to unavailable items may be displayed in red.

When an attendant identifies a food component as available for purchase but temporarily unavailable for deliver in screen 140, the delay period is substantially immediately sent to all self-service computers 12 and displayed by self-service application 20.

Figure 9:
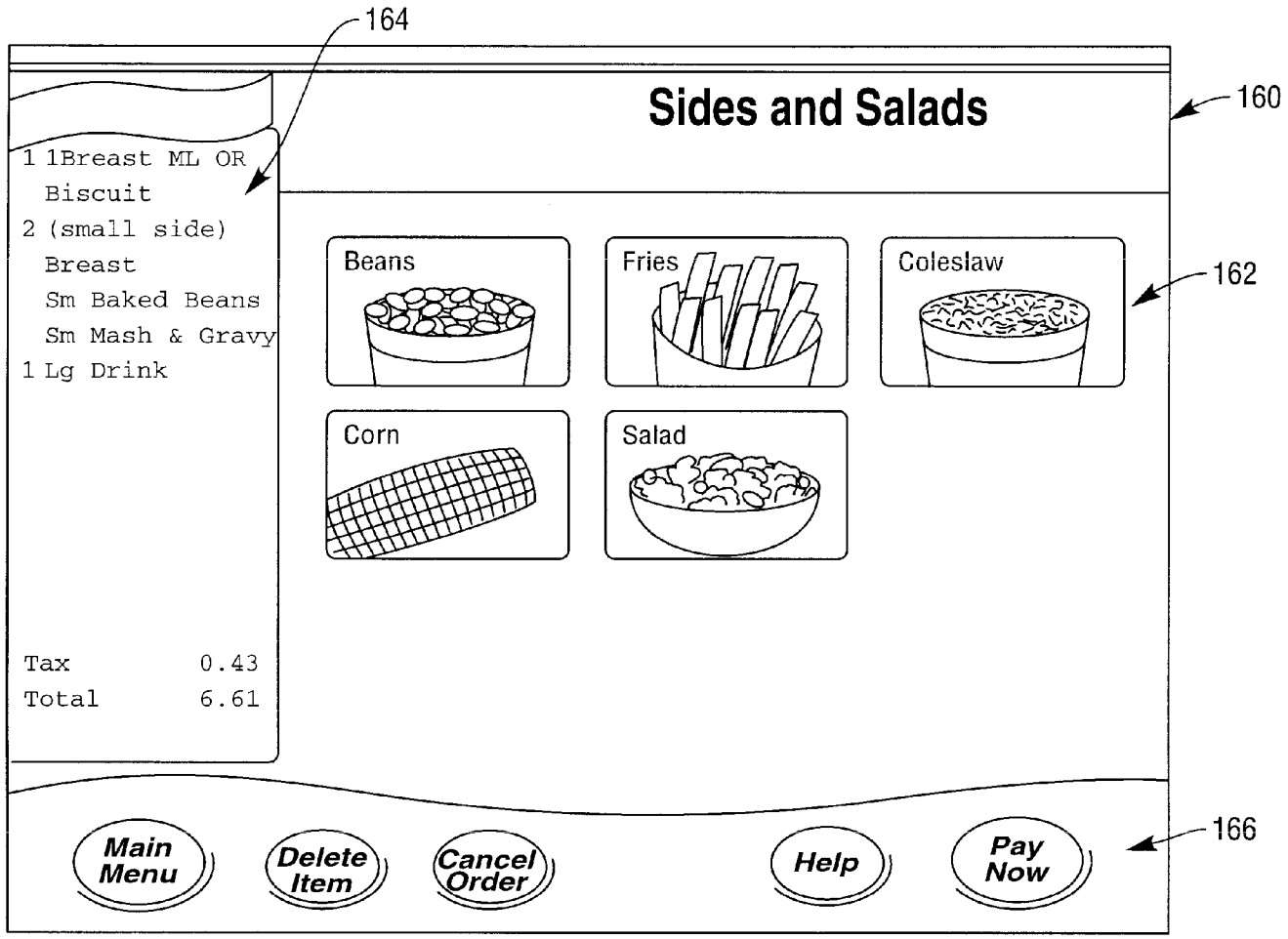
FIG. 9-11 illustrate example screens of a self-service computer.
Figure 10:
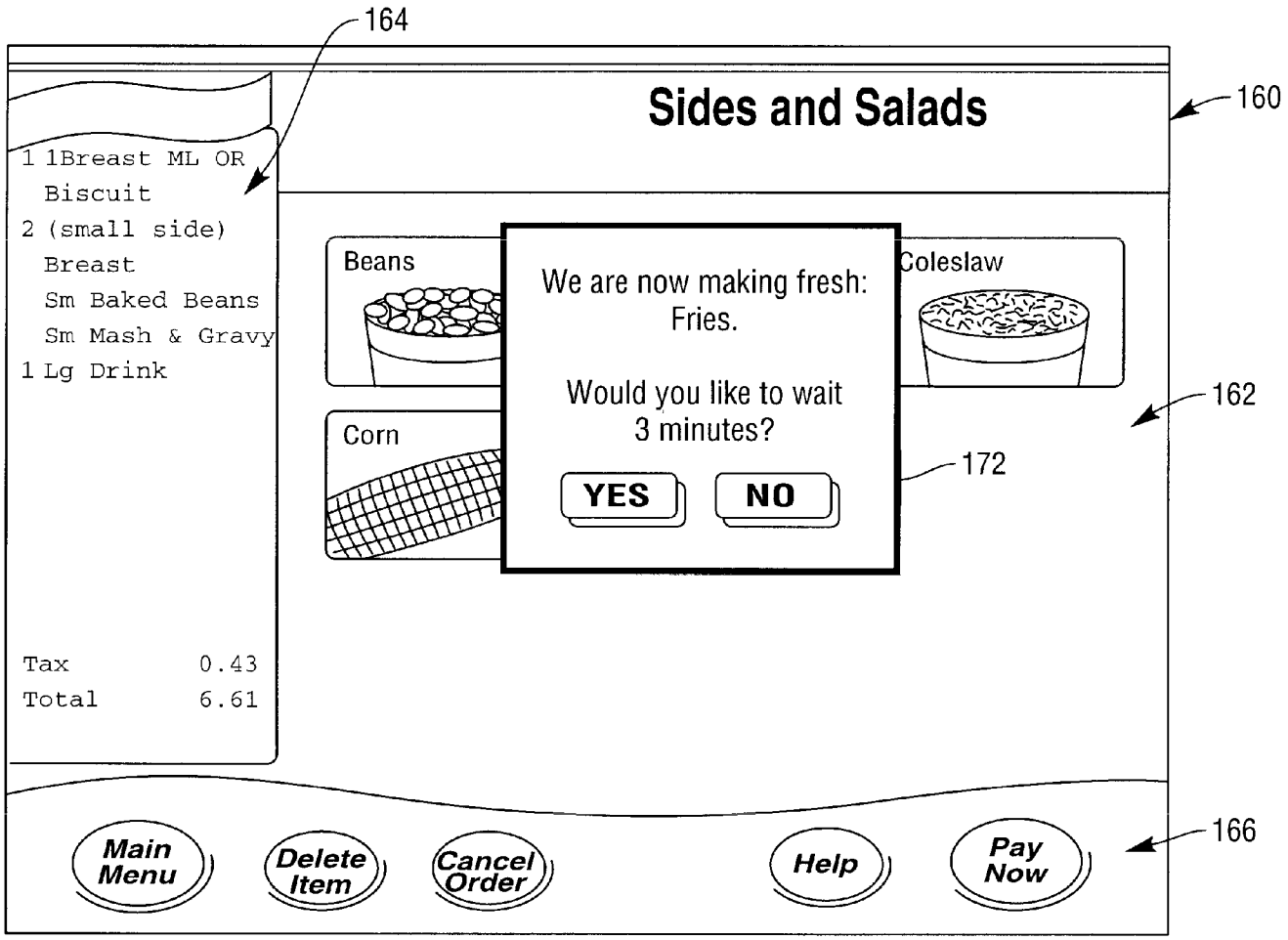
Figure 11:
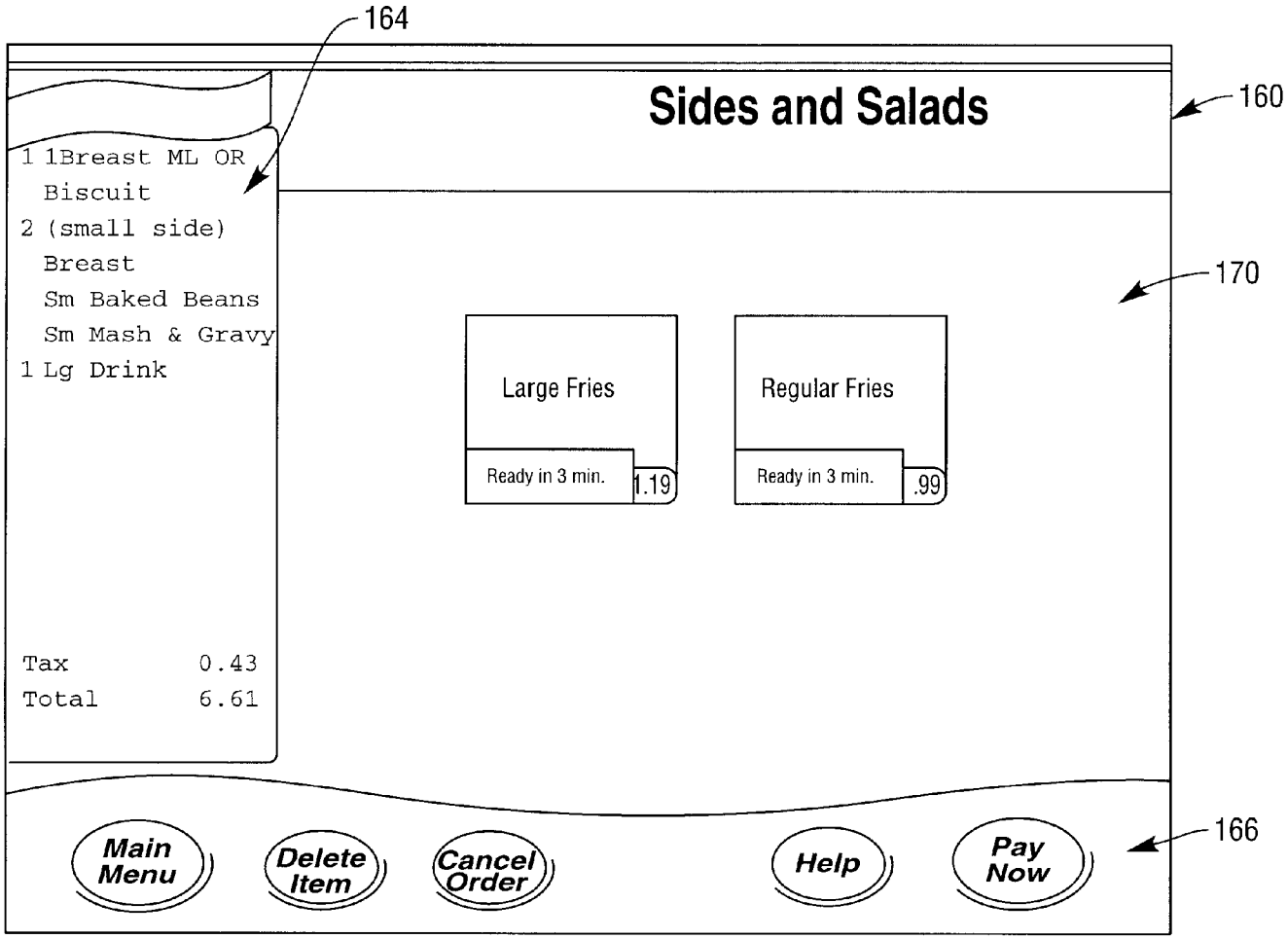

Turning now to FIG. 9-11, customer ordering of items available for purchase but unavailable for delivery at self-service computer 12 is illustrated.

With reference to FIG. 9, example customer screen 160 includes a menu section 162 containing choices, a receipt section 164 containing a running tally of customer selections, and a control section 166 containing navigation choices.

Items whose status has been changed to unavailable purchase and delivery may be indicated as grayed out, making them unavailable for selection and purchase. Since "Fries" were marked by the attendant as temporarily unavailable, Fries are still available for purchase and selection by the customer.

With reference to FIG. 10, selection of Fries results in a message box 172 appearing, since Fries were marked by the attendant as temporarily unavailable for delivery.

Message box 172 contains the message, "We are now making fresh: Fries. Would you like to wait 3 minutes". The message box may include "yes" and "no" buttons, thereby allowing a customer to affirm or cancel the selection of French fries. If the customer selects "yes", the item is ordered. Otherwise, the item is not ordered.

With reference to FIG. 11, graphic 170, appears in the forefront over example customer screen 160 containing a selection for Fries. Graphic 170 includes choice buttons for "Large Fries" and "Regular Fries", the waiting time, and the price. If the customer makes a selection, the corresponding item is ordered. Otherwise, the item is not ordered.

Graphic 170 is displayed when any screen with an item that is delayed or contains delayed components is displayed, following a selection of the item and display of message box 172.

Although particular reference has been made to certain embodiments, variations and modifications are also envisioned within the spirit and scope of the following claims.

What is claimed is:

1. An interaction method comprising:

generating a menu of items available for purchase to display to a customer at a self-service kiosk located at a quick service restaurant;

determining that at least one of the menu items and a second menu item are available at the quick service restaurant but delayed while the at least one menu item and second menu item are prepared for consumption;

calculating a unique number of minutes until the menu item and the second menu item will be prepared;

receiving a selection from a customer at the self-service kiosk requesting to order the at least one menu item and the second menu item;

displaying an indication to the customer that the at least one menu item and the second menu item are available at the quick service restaurant but delayed a unique calculated number of minutes until the at least one menu item and the second menu item are prepared for consumption, and displaying the unique calculated number of minutes as a longest delay time for all menu items currently being delayed when other menu items are also being delayed and updating the indication displayed when the at least one menu item and the second menu item becomes available when the longest delay time was being displayed, and displaying the longest delay time as a unique countdown timer for the at least one menu item and the second menu item, wherein displaying further includes displaying display information on both a display of the self-service kiosk and an attendant display of an attendant computer enabling an attendant to watch in real time customer selections from the display information as the customer performs the customer selections on the self-service kiosk, wherein displaying further includes generating the display information for the self-service kiosk and the attendant display as display screens, an attendant display screen generated from configuration data that includes a screen identifier, customer provided input data, and customer selection data, the screen identifier processed to obtain screen data for the attendant display screen that is populated with the customer provided input data and the customer selection data to generate the attendant display screen, and wherein displaying further includes presenting at least one additional attendant display screen associated with a different self-service kiosk within a window rendered on the attendant display with the attendant display screen and zooming the attendant display screen to full screen view based on a touch of the attendant display screen on the attendant display and returning the window with the attendant display screen and the at least one additional attendant display screen viewable together within the window based on a touch of a home button provided in an administrative section of the window on the attendant display;

presenting a message box to the customer to interactively affirm or cancel through a selection of one of the delayed items and including within the message box an indication that the delayed items are being processed along with a unique remaining time for a wait on the delayed items and a selection option to indicate that the customer is willing to wait or unwilling to wait, wherein a selection of unwilling to wait cancels the previously ordered delayed items made by the customer;

presenting a ready now message before the longest delay time when the attendant changes availability for the delayed items before the longest delay time; and adjusting the longest delay time by the attendant through arrow buttons available through an interface on the attendant computer operated by the attendant;

receiving the selection from the customer through the message box as an affirmation to purchase the delayed items.

2. The method of claim 1, wherein the indication comprises a grayed image of the at least one menu item.

3. The method of claim 1, wherein the indication comprises a message stating that the at least one menu item is delayed while the at least one menu item is prepared for consumption.

4. The method of claim 1, wherein the calculated number of minutes includes a calculated number of minutes and seconds that the at least one menu item is delayed.

5. The method of claim 4, wherein the calculated number of minutes is a decreasing time remaining until the menu item is available.

6. The method of claim 1, wherein the number of minutes is less than 15 minutes.

7. The method of claim 1, wherein determining that the at least one menu item is available but delayed further comprises:

receiving from the attendant computer an update that an attendant has marked the at least one menu item as available but delayed.

8. The method of claim 7, wherein the update is received substantially simultaneously following the receipt of the marking by the attendant computer.

9. A method for identifying temporarily delayed items sold by a vendor at a self-service kiosk located in an establishment of the vendor comprising:

providing for display of one or more items available for purchase at the establishment;

determining that at least one of the one or more displayed items and a second menu item are available but temporarily delayed while preparing the at least one item and the second menu item;

determining time periods the at least one temporarily delayed item and second menu item will be delayed while preparing the at least one item and the second menu item;

enabling display of a message to a user of the self-service kiosk comprising an indication that the at least one item and the second menu item are available but temporarily delayed while preparing the at least one item and the second menu item, the message comprising an indication of a delay period until the at least one item and second menu item will be prepared and displaying with the message as a longest delay time for all items currently being delayed when other items are also being delayed and updating the message displayed when the at least one item and second menu item become available when the longest delay time was being displayed, and displaying a unique countdown timers with the longest delay time, wherein enabling further includes displaying display information on both a display of the self-service kiosk and an attendant display of an attendant computer enabling an attendant to watch in real time customer selections from the display information as the customer performs the customer selections on the self-service kiosk, wherein displaying further includes generating the display information for the self-service kiosk and the attendant display as display screens, an attendant display screen generated from configuration data that includes a screen identifier, customer provided input data, and customer selection data, the screen identifier processed to obtain screen data for the attendant display screen that is populated with the customer provided input data and the customer selection data to generate the attendant display screen, and wherein displaying further includes presenting at least one additional attendant display screen associated with a different self-service kiosk within a window rendered on the attendant display with the attendant display screen and zooming the attendant display screen to full screen view based on a touch of the attendant display screen on the attendant display and returning the window with the attendant display screen and the at least one additional attendant display screen viewable together within the window based on a touch of a home button provided in an administrative section of the window on the attendant display;

presenting a message box to a customer to interactively affirm or cancel through a selection of the at least one temporarily delayed item or second menu item and including within the message box an indication that the at least one temporarily delayed item and second menu item are being processed along with unique remaining times for waits on the at least one temporarily delayed items and a selection option to indicate that the customer is willing to wait or unwilling to wait, wherein a selection of unwilling to wait cancels the previously ordered delayed items made by the customer;

presenting a ready now message before the longest delay time when the attendant changes availability for the delayed items before the longest delay time; and adjusting the longest delay time by the attendant through arrow buttons available through an interface on the attendant computer operated by the attendant;

receiving a request from the user as the selection from the message box for affirming a purchase of the at least one temporarily delayed items to be prepared while the customer waits at the establishment.

10. The method of claim 9, wherein the delay period until the at least one item can be delivered is calculated in minutes.

11. The method of claim 10, wherein the delay period is less than 15 minutes.

12. The method of claim 10, wherein the delay period until the at least one item can be delivered is calculated in minutes and seconds.

13. The method of claim 9, wherein determining that the at least one item is temporarily delayed further comprises:

receiving from the attendant computer an update that an attendant has marked the at least one item as temporarily unavailable.

14. The method of claim 13, wherein the update is received substantially simultaneously following the receipt of the marking by the attendant computer.

15. The method of claim 9, wherein the message comprises a countdown of the delay period until the at least one item is available.

* * * * *